US005884362A

United States Patent [19]

Tsai

[11] Patent Number: 5,884,362

[45] Date of Patent: Mar. 23, 1999

[54] EXPANDABLE HANDLE OF LUGGAGE

[76] Inventor: James Tsai, 103, Ta-Ming 1 Rd., Tung Pao Tsun, Tan Tzu Hsiang, Taichung Hsien, Taiwan

[21] Appl. No.: 881,390

[22] Filed: Jun. 24, 1997

[51] Int. Cl.[6] ..... A45C 13/04

[52] U.S. Cl. ..... 16/115; 280/655; 280/655.1

[58] Field of Search ..... 16/115; 190/115, 190/117, 118; 280/655, 655.1, 47.29; 403/93, 96

[56] References Cited

U.S. PATENT DOCUMENTS

| | | | |
|---|---|---|---|
| 4,463,632 | 8/1984 | Parke | 403/93 X |
| 5,058,239 | 10/1991 | Lee | 403/93 X |
| 5,143,468 | 9/1992 | Pausch | 403/96 X |
| 5,613,273 | 3/1997 | Tsai | 16/115 |
| 5,689,654 | 11/1997 | Wang | 16/115 |
| 5,713,441 | 2/1998 | Chen | 16/115 X |
| 5,713,633 | 2/1998 | Lu | 403/93 X |

*Primary Examiner*—Anthony Knight
*Assistant Examiner*—David E. Bochna
*Attorney, Agent, or Firm*—Browdy and Neimark

[57] ABSTRACT

A luggage handle is composed of two outer tubes fastened with the luggage frame, two inner tubes movable received in the outer tubes, a hand grip fastened with the top ends of the inner tubes, a retaining mechanism for locating the inner tubes after the inner tubes are extracted from the outer tubes, and two toggle members enabling the inner tubes to form various angles with the outer tubes.

6 Claims, 8 Drawing Sheets

EXPANDABLE HANDLE OF LUGGAGE

FIELD OF THE INVENTION

The present invention relates generally to a luggage, and more particularly to an expandable handle of the luggage.

BACKGROUND OF THE INVENTION

As illustrated in FIGS. 1–4, a prior art expandable handle of the luggage is composed of two outer tubes 11 fastened with a shell of the luggage, and two joint members 12. The joint members 12 are made up of a housing 13, a rotary member 14 provided with two locating slots 141 and 142, a guide rod 15, and a spring 16 fitted over the guide rod 15, a locating member 17 provided with a projection 171 which is urged by the spring 16. Two inner tubes 18 are received in the outer tubes 11 via the two rotary members 14. A handle 19 is fastened with the inner tubes 18. The inner tubes 18 can be first pulled out of the outer tubes 11 by the handle 19 and can be then forced by the handle 19 to form a predetermined angle with the outer tubes 11, as shown in FIGS. 3 and 4. The prior art handle described above is not versatile in function.

SUMMARY OF THE INVENTION

The primary objective of the present invention is to provide luggage with an expandable handle which can be adjusted to suit persons of various heights.

In keeping with the principle of the present invention, the foregoing objective of the present invention is attained by an expandable handle, which is composed of two outer tubes fastened with a luggage frame, two inner tubes movably received in the outer tubes, a hand grip fastened with the top ends of the inner tubes, a retaining mechanism for locating the inner tubes, and two toggle members enabling the inner tubes to form various angles with the outer tubes.

DETAILED DESCRIPTION OF THE INVENTION

Figure 1:
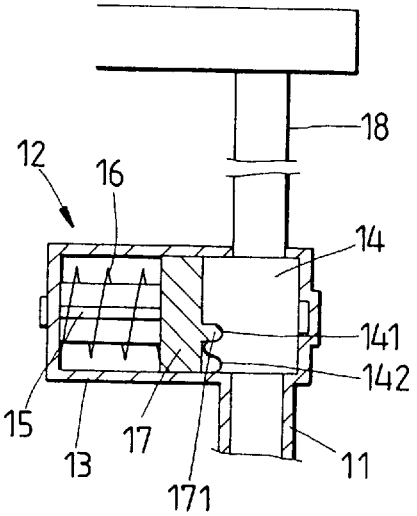
FIG.1 (PRIOR ART)
FIG. 1 shows a schematic view of a prior art expandable handle for luggage.
Figure 2:
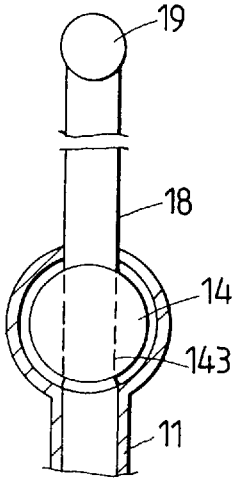
FIG. 2 (PRIOR ART)
FIG. 2 shows a sectional view of a portion taken along the direction indicated by a line 2—2 as shown in FIG. 1.
Figure 3:
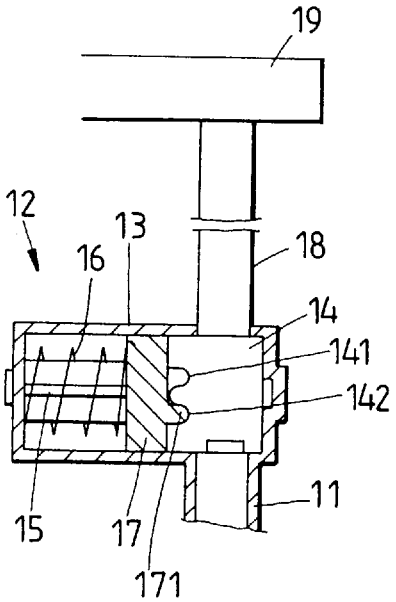
FIG. 3 (PRIOR ART)
FIG. 3 shows another schematic view of the prior art of FIG. 1.
Figure 4:
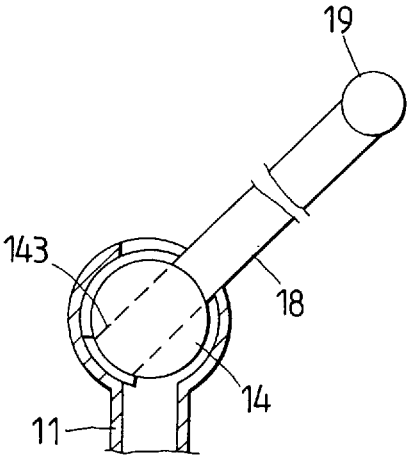
FIG.4 (PRIOR ART)
FIG. 4 shows a sectional view of a portion taken along the direction indicated by a line 4—4 as shown in FIG. 3.
Figure 5:
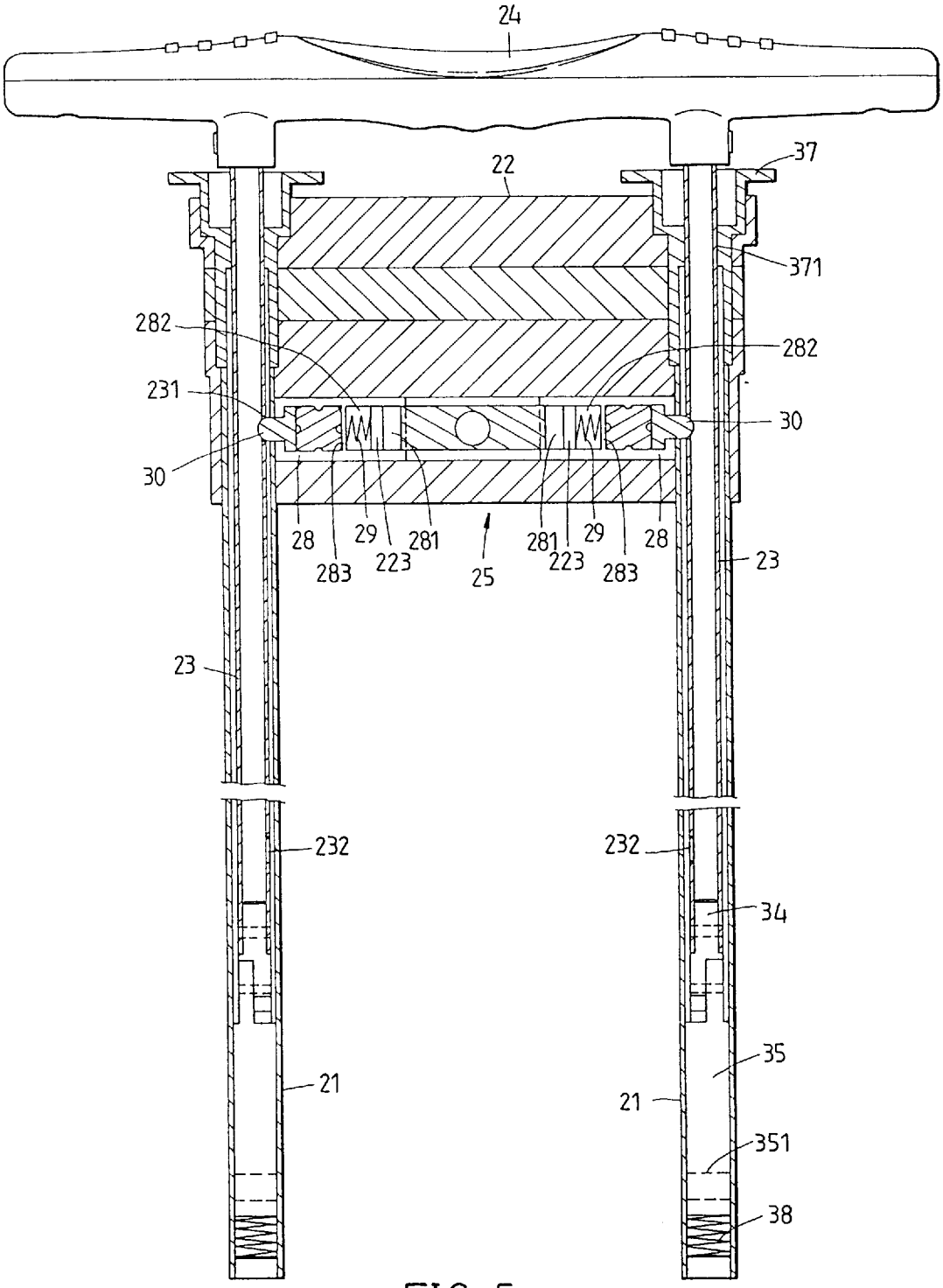
FIG. 5 shows a schematic view of the present invention.
Figure 6:
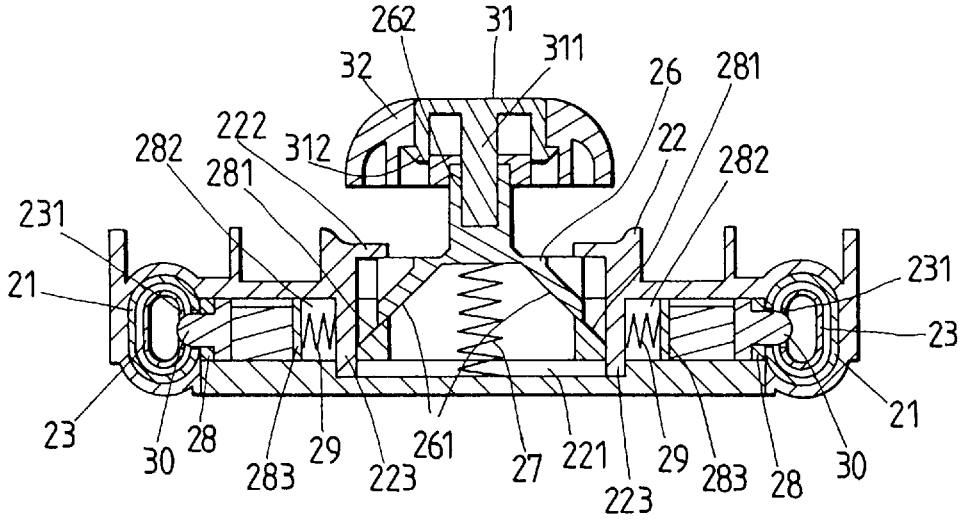
FIG. 6 shows a sectional view taken along the direction indicated by a line 6—6 shown in FIG. 5.

As shown in FIGS. 5 and 6, a luggage handle embodied in the present invention is composed of the component parts, which are described explicitly hereinafter.

Two outer tubes 21 are fastened with a base 22 of a luggage frame such that the two outer tubes 21 are parallel to each other.

Two inner tubes 23 are expandably received in the outer tubes 21 and are provided respectively with locating holes 231 and 232.

A hand grip 24 is fastened securely with the top ends of the inner tubes 23.

A retaining mechanism 25 is located in the base 22 and composed of an action member 26 having two inclined faces 261, a spring 27, two link members 28, two retaining members 30, and a button 31. The spring 27 is fitted over the action member 26 such that one end of the spring 27 urges a wall 221 of the base 22. In the meantime, the action member 26 is retained by a wall 222 of the base 22. The link members 28 are provided with a slanted face 281 complementary with the inclined face 261. An indentation 282 is located by the slanted face 281 to facilitate the passing of a projection 223 of the base 22. The two link members 28 are provided respectively with a spring 29 fitted thereover such that one end of the spring 29 urges the projection 223, and that another end of the spring 29 urges the wall 283 of the link member 28. The two retaining members 30 are fastened with the two link members 28 such that the retaining members 30 are engageable with the locating holes 231 and 232 of the inner tubes 23. The projection 311 of the button 31 is engaged with the slot 262 of the action member 26. Two link members 28 are actuated by the inclined face 261 and the slanted face 281 to move towards each other so as to enable the retaining members 30 to move from a retaining position to a releasing position. When the button 31 is relieved of the pressure exerting thereon, the action member 26 is forced by the spring 27 to displace. The projection 312 of the button 31 is retained and located by a button cap 32. The link members 28 are forced by the springs 29 to move towards the retaining position.

Figure 10:
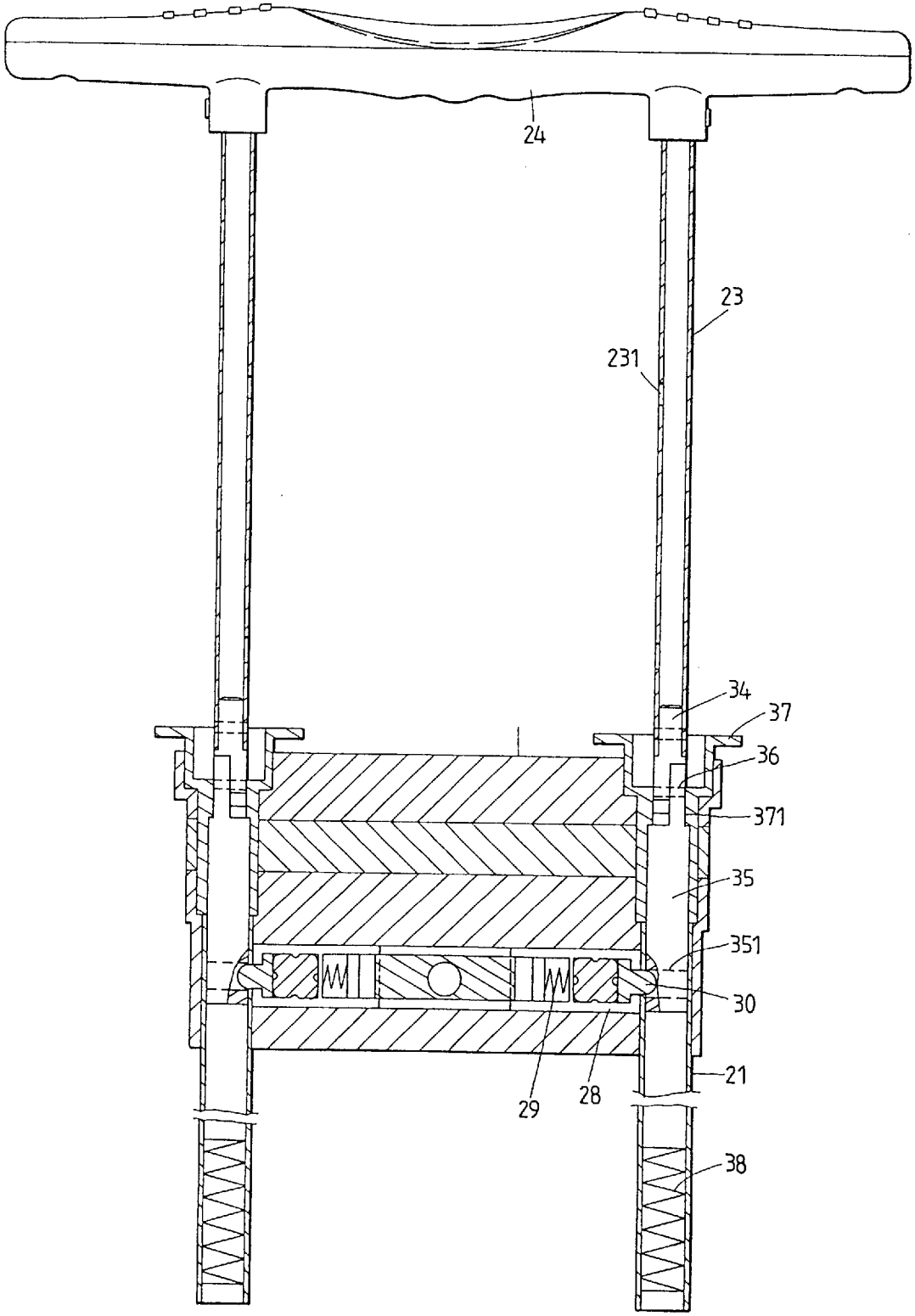
FIG. 10 shows still another schematic view of the present invention.
Figure 11:
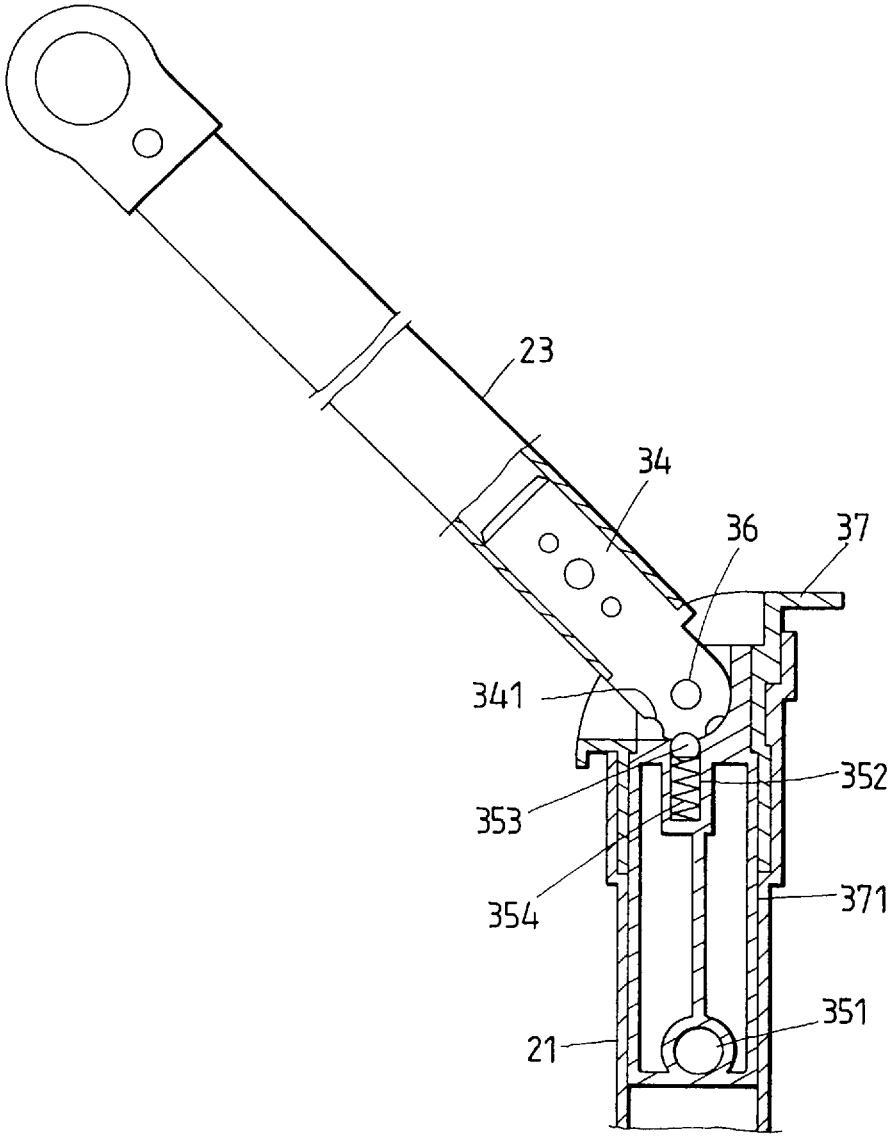
FIG. 11 shows a sectional view taken along the direction indicated by a line 11—11 as shown in FIG. 10.

Two toggle members 33 shown in FIGS. 5 and 11 are composed of two elements 34 and 35, which are rotatably fastened respectively at one end thereof with a shaft 36. The element 34 is located in the inner tube 23. The element 35 is provided with a locating hole 351 and is received in the outer tube 21 such that the element 35 is aligned with the inner tube 23. When the inner tube 23 is pulled out of the outer tube 21, as shown in FIGS. 10 and 11, the locating hole 351 is engaged with the retaining member 30 so as to enable the inner tube 23 to form an angle along with the outer tube 21. The elements 34 and 35 may be provided at the junction thereof with the retaining structure to enable the toggle to be located at various angles. The element 34 is provided with recesses 341 while the element 35 is provided with a receiving slot 352 for receiving a locating member 353 (a steel ball) and a spring 354 capable of urging the locating member 353 to engage the recesses 341, so as to enable the elements 34 and 35 to be located at various angles.

Figure 8:
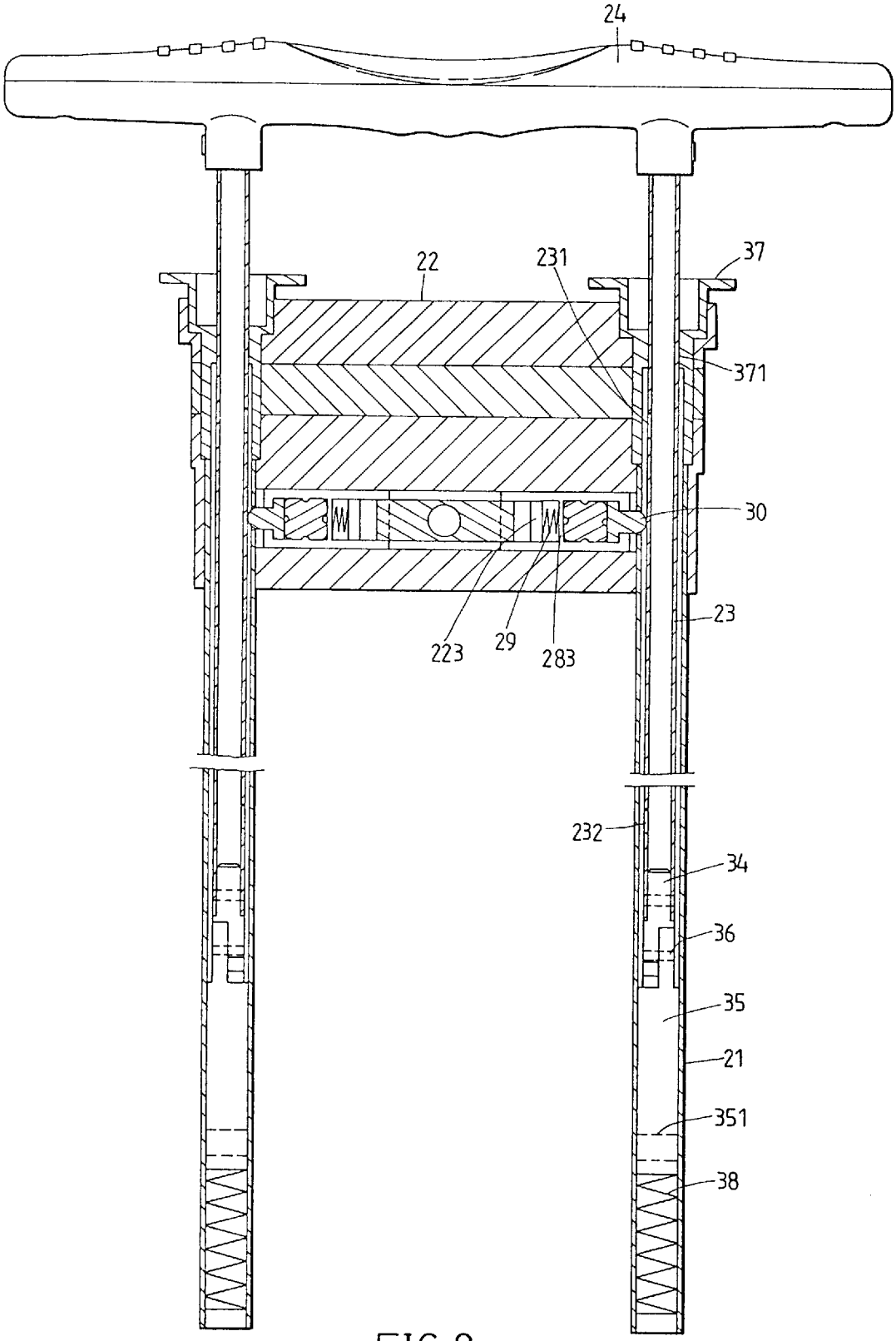
FIG. 8 shows another sectional schematic view of the present invention.

Two elastic members 38 are fastened with the bottom ends of the outer tubes 21. When the inner tubes 23 are completely retracted, the elastic members 38 are compressed, as shown in FIG. 5. When the retaining mechanism 25 is released, the inner tubes 23 are ejected by the force of the compressed elastic members 38 to facilitate the catching of the hand grip 24 by a person's hand, as illustrated in FIG. 8.

Figure 7:
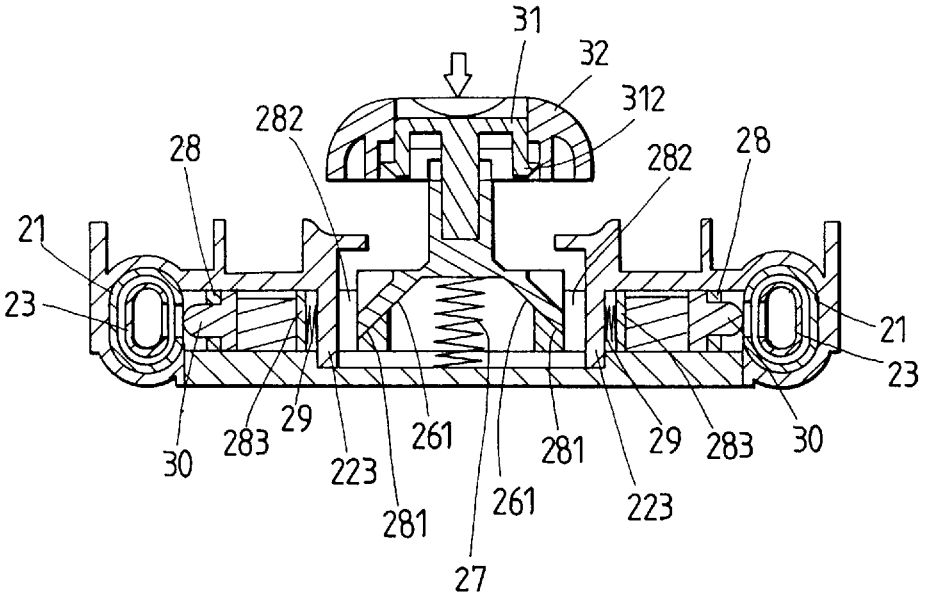
FIG. 7 shows a sectional schematic view of the present invention.
Figure 9:
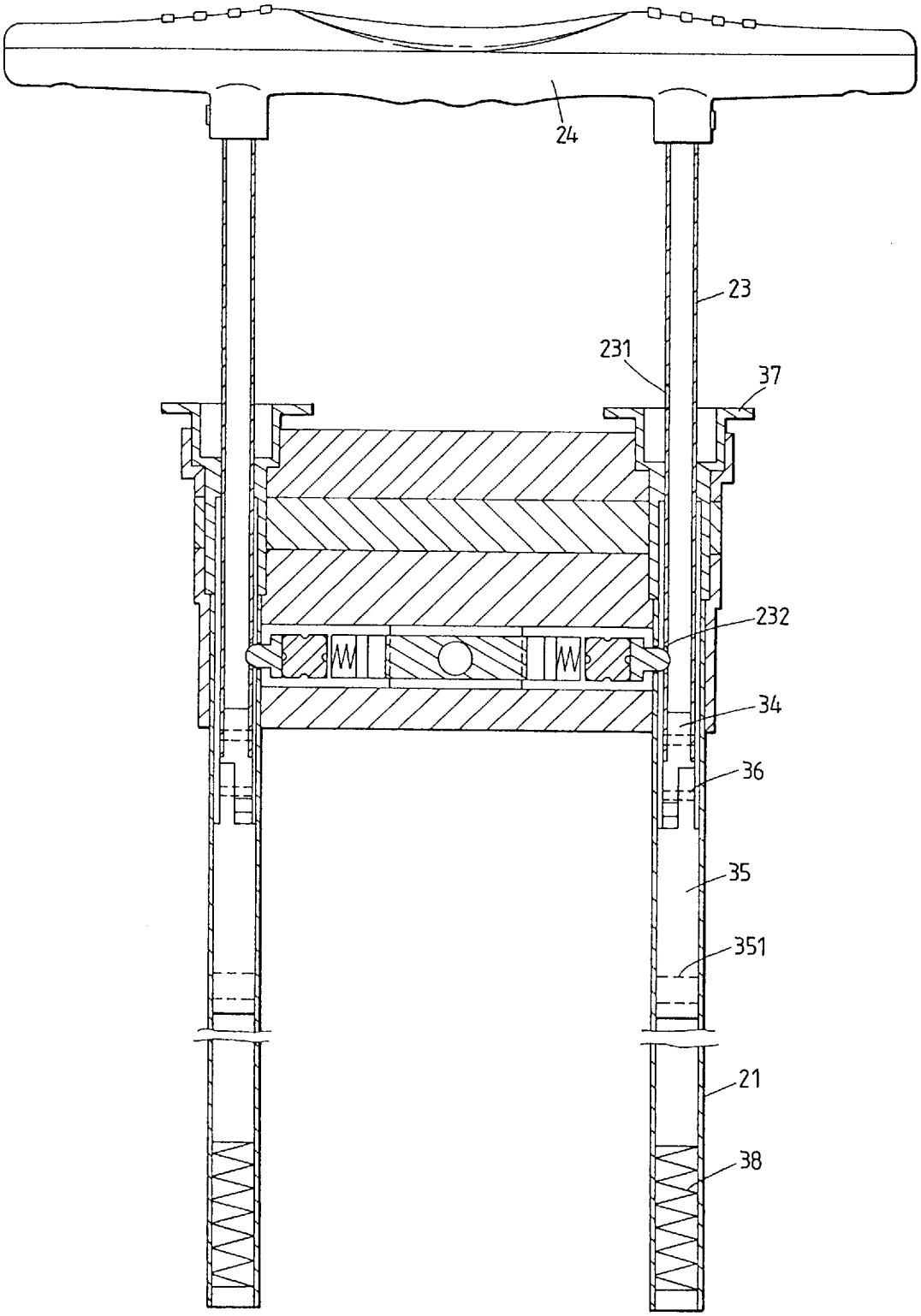
FIG. 9 shows still another schematic view of the present invention.

As illustrated in FIG. 5, the handle of the present invention is not at work. As the button 31 is pressed, the retaining member 30 is shifted to the releasing position (FIG. 7) from the retaining position (FIG. 6). In the meantime, the inner tubes 23 are partially ejected by the elastic members 38, as shown in FIG. 8. As the hand grip 24 is lifted, the inner tubes 23 are extracted such that the locating holes 232 of the inner tubes 23 are engaged with the retaining members 30, as shown in FIG. 9. However, the inner tubes 23 and the outer tubes 21 can not form a predetermined angle. If the button 31 is pressed for the second time and the inner tubes 23 are extracted to a maximum limit such that the retaining members 30 are engaged with the locating holes 351 of the element 35, as shown in FIG. 10. As a result, the inner tubes 23 and the outer tubes 21 are able to form an angle, as shown in FIG. 11. It must be noted here that the element 35 has a greater diameter than the axial hole 371 of the sleeve 37 of the outer tube 21, thereby preventing the inner tubes 23 from becoming completely disengaged with the outer tubes 21. In addition, the link members 28 of the retaining mechanism may be made integrally with the retaining members 30.

Figure 12:
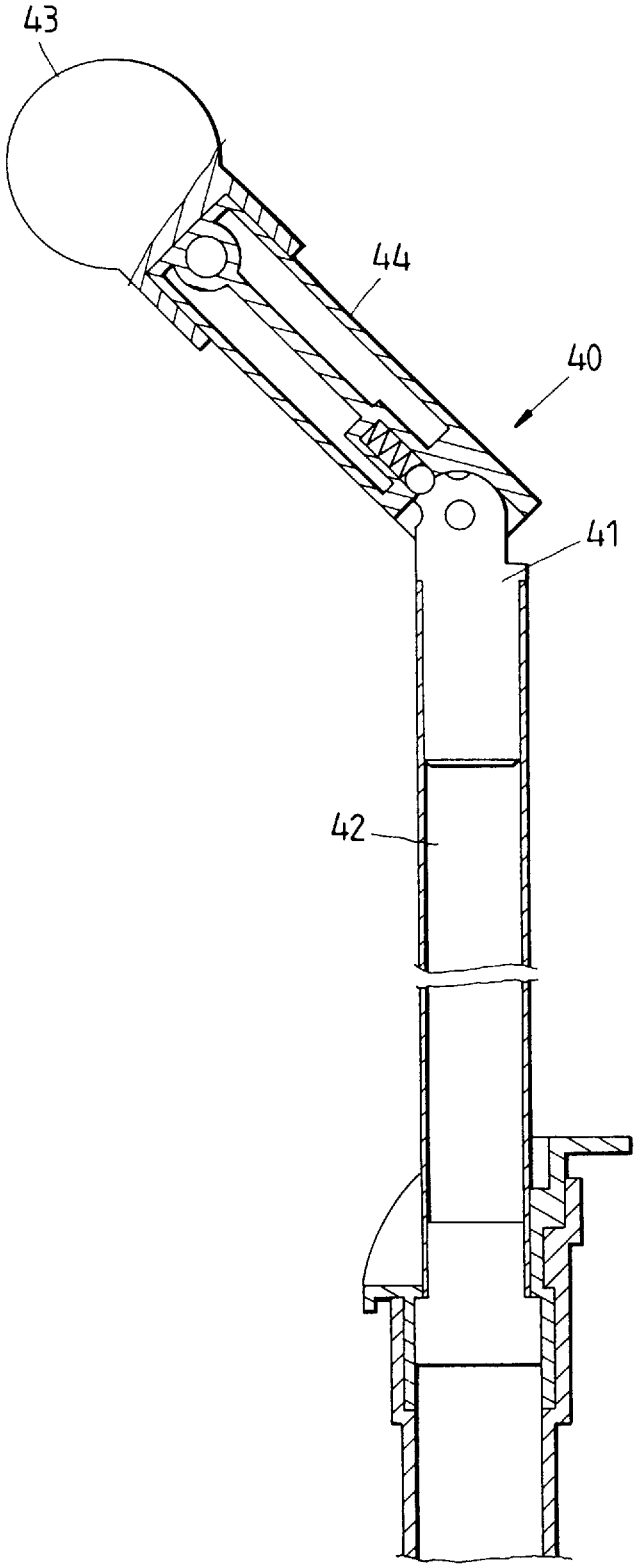
FIG. 12 shows a schematic view of another preferred embodiment of the present invention.

As shown in FIG. 12, a luggage handle of the second preferred embodiment of the present invention is different from that of the first preferred embodiment of the present invention in that the former comprises toggle members 40 having an element 41 which is mounted at the top end of the inner tube 42, and that a hand grip 43 is mounted on the top end of the element 44 of the toggle members 40 to enable the hand grip 43 to bend downwards by means of the toggle members 40 so as to facilitate the pushing or the pulling of the luggage.

What is claimed is:

1. An expandable handle of a luggage, said handle comprising:

two outer tubes fastened with a luggage frame;

two inner tubes received respectively in said outer tubes such that said inner tubes can be extracted and retracted, said inner tubes provided respectively with at least one locating hole;

a hand grip fastened with one end of said inner tubes;

a retaining mechanism consisting of two retaining members engageable and disengageable with said locating holes of said inner tubes, said retaining mechanism further consisting of a button capable of causing said retaining members to disengage said locating holes of said inner tubes at such time when said button is exerted on by an external force; and two toggle members consisting of two elements which are respectively fastened at one end thereof with a shaft to enable said hand grip to bend;

wherein said outer tubes are provided respectively at one end thereof with a base fastened therewith; and wherein said retaining mechanism is located in said base and composed of:

an action member having two inclined faces;

a spring urging said action member and a wall of said base;

two link members provided with a slanted face complementary with said inclined faces of said action member, said link members further provided respectively with a spring capable of forcing said link members to displace;

two retaining members fastened with said link members such that said retaining members are engageable with said locating holes of said inner tubes and a button connected with said action member such that said button is capable of actuating said action member to displace at such time when said button is exerted on by an external force, wherein said link members are provided respectively with an indentation contiguous to said slanted face; wherein said base is provided in a wall thereof with a projection extending through said indentation; and wherein said spring of said link member has one end urging said projection, and another end urging said link member.

2. The handle as defined in claim 1, wherein one of said two elements of said toggle members is fastened with one end of said inner tubes; and wherein another one of said two elements is provided with a locating hole and is located in said outer tubes such that said another one of said two elements is coaxially engaged with said inner tube, and that said locating hole of said another one of said two elements is engaged with said retaining member at such time when said inner tubes are extracted to form an angle with said outer tubes.

3. The handle as defined in claim 1, wherein one of said two elements of said toggle members is fastened with one end of said inner tubes; and wherein another one of said two elements of said toggle members is fastened with said hand grip.

4. The handle as defined in claim 1, wherein said two elements of said two toggle members are provided at a junction thereof with a retaining structure enabling said toggle members to be located at various angles.

5. The handle as defined in claim 4, wherein said retaining structure is composed of an element having a recess, and another element having a receiving slot for receiving a locating member and a spring urging said locating member to engage said recess so as to enable said two elements to be located at various angles.

6. The handle as defined in claim 1, wherein said outer tubes are provided respectively at one end thereof with an elastic member capable of ejecting said inner tubes which are no longer located.

* * * * *